US012326062B2

(12) United States Patent
El Nekhily et al.

(10) Patent No.: US 12,326,062 B2
(45) Date of Patent: Jun. 10, 2025

(54) REPAIRING WELLBORES WITH FLUID MOVEMENT BEHIND CASING

(71) Applicant: Saudi Arabian Oil Company, Dhahran (SA)

(72) Inventors: Mohamed M. El Nekhily, Al Khobar (SA); Khalsa Kanwal Bahadur, Al Khobar (SA); Ibrahim A. Al-Obaidi, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/585,910

(22) Filed: Feb. 23, 2024

(65) Prior Publication Data

US 2024/0191595 A1 Jun. 13, 2024

Related U.S. Application Data

(62) Division of application No. 17/712,799, filed on Apr. 4, 2022, now Pat. No. 11,939,835.

(51) Int. Cl.

| | |
|---|---|
| ***E21B 33/14*** | (2006.01) |
| ***E21B 23/06*** | (2006.01) |
| ***E21B 29/00*** | (2006.01) |

(52) U.S. Cl.

CPC ..... *E21B 33/14* (2013.01); *E21B 23/06* (2013.01); *E21B 29/002* (2013.01)

(58) Field of Classification Search

CPC ..... E21B 33/14

See application file for complete search history.

(56) References Cited

U.S. PATENT DOCUMENTS

| | | | | |
|---|---|---|---|---|
| 5,295,541 | A | 3/1994 | Ng et al. | |
| 11,939,835 | B2 | 3/2024 | El Nekhily et al. | |
| 2009/0000793 | A1* | 1/2009 | Guillot | E21B 17/1028 166/380 |
| 2009/0183884 | A1 | 7/2009 | Hansen | |
| 2009/0205843 | A1* | 8/2009 | Gandikota | E21B 33/128 166/387 |
| 2014/0083702 | A1 | 3/2014 | Godfrey et al. | |
| 2015/0275605 | A1 | 10/2015 | Bennett et al. | |
| 2017/0044864 | A1 | 2/2017 | Sabins et al. | |

(Continued)

FOREIGN PATENT DOCUMENTS

| | | |
|---|---|---|
| RU | 2386779 | 4/2010 |

OTHER PUBLICATIONS

Ansari et al., "Innovative Planning and Remediation Techniques for Restoring the Well Integrity by Curing High Annulus-B Pressure and Zonal Communication," presented at the International Petroleum Technology Conference, Nov. 2016, Bangkok, Thailand, 25 pages.

(Continued)

*Primary Examiner* — William D Hutton, Jr.
*Assistant Examiner* — Avi T Skaist
(74) *Attorney, Agent, or Firm* — Fish & Richardson P.C.

(57) ABSTRACT

A section of casing within a wellbore is milled. After milling the section of the wellbore, the section of the wellbore is underreamed through to a next layer of casing. A setting fluid is squeezed into the section. The setting fluid penetrates micro-channels exposed by the milling and underreaming A scab liner is installed over the section. The scab liner is secured within the wellbore.

7 Claims, 8 Drawing Sheets

Run Underreamer BHA

(56) References Cited

U.S. PATENT DOCUMENTS

| | | | | |
|---|---|---|---|---|
| 2020/0277841 | A1 | 9/2020 | Olliff et al. | |
| 2022/0018201 | A1* | 1/2022 | Bouldin | E21B 33/14 |
| 2022/0018202 | A1 | 1/2022 | Rutherford et al. | |
| 2023/0313636 | A1 | 10/2023 | El Nekhily et al. | |

OTHER PUBLICATIONS

Ansari et al., "Innovative Remediation Techniques for Restoring Well Integrity by Curing High Annulus-B Pressure and Zonal Communication," SPE 185911, presented at the SPE Bergen One Day Seminar, Apr. 2017, Bergen, Norway, 23 pages.

Morris et al., "Innovative Remedial Cementing Solution Provides Annular Isolation in Duyong B-4 Petronas Carigali," IADC/SPE 88017, presented at the Asia Pacific Drilling Technology Conference and Exhibition, Sep. 2004, Kuala Lumpur, Malaysia, 11 pages.

Weatherford packer systems brochure, "PCR Cement Retainer," Weatherford International Ltd., 2007, 2 pages.

* cited by examiner

REPAIRING WELLBORES WITH FLUID MOVEMENT BEHIND CASING

CROSS-REFERENCE TO RELATED APPLICATIONS

This application is a divisional and claims the benefit of priority of U.S. patent application Ser. No. 17/712,799, dated Apr. 4, 2022, the entire contents of which are incorporated by reference in its entirety.

TECHNICAL FIELD

This disclosure relates to wellbore and casing repair.

BACKGROUND

For hydrocarbon production, wellbores are formed within geologic formations to produce hydrocarbons from a hydrocarbon reservoir located in a geologic formation. Alternatively or in addition, such wellbores are used to inject fluids into geologic formations. In some implementations, the wellbores are lined with tubulars known as casing strings. Casing strings are typically secured to a wellbore with cement or a similar binder. In typical operation, working fluid, whether the fluid be production or injection fluid, is directed and contained by an internal surface of the casing.

SUMMARY

This disclosure describes technologies relating to repairing wellbores with fluid movement behind the well casing.

An example implementation of the subject matter described within this disclosure is a method with the following features. A section of casing within a wellbore is milled. After milling the section of the wellbore, the section of the wellbore is underreamed through to a next layer of casing. A setting fluid is squeezed into the section. The setting fluid penetrates micro-channels exposed by the milling and underreaming. A scab liner is installed over the section. The scab liner is secured within the wellbore.

Aspects of the example method, which can be combined with the example method alone or in combination with other aspects, include the following. Securing the scab liner includes expanding a packer encircling the scab liner. The expanded packer contacts the next layer of casing. The scab liner is cemented.

Aspects of the example method, which can be combined with the example method alone or in combination with other aspects, include the following. An uphole section of an annulus, defined by an outer surface of the scab liner and an inner surface of the next layer of casing, is sealed, by the packer, from a downhole section of the annulus.

Aspects of the example method, which can be combined with the example method alone or in combination with other aspects, include the following. The setting fluid includes resin or cement.

Aspects of the example method, which can be combined with the example method alone or in combination with other aspects, include the following. The setting fluid is cured.

Aspects of the example method, which can be combined with the example method alone or in combination with other aspects, include the following. Squeezing the setting fluid includes setting a plug downhole of the section. A retainer is set uphole of the section. Fluid is pressurized by the retainer. The setting fluid is flowed into channels responsive to pressurizing the fluid.

Aspects of the example method, which can be combined with the example method alone or in combination with other aspects, include the following. The retainer is drilled out.

Aspects of the example method, which can be combined with the example method alone or in combination with other aspects, include the following. The plug is drilled out.

Aspects of the example method, which can be combined with the example method alone or in combination with other aspects, include the following. Fluid is injected or produced by the wellbore after securing the scab liner within the wellbore.

An example implementation of the subject matter described within this disclosure is a scab liner arrangement with the following features. An outer casing installed within a wellbore. An expandable packer encircles a central tubular. The expandable packer is configured to expand and seat against the outer casing within a wellbore.

Aspects of the example scab liner arrangement, which can be combined with the example scab liner arrangement alone or in combination with other aspects, include the following. Cement or resin secures the central tubular to the outer casing.

An example implementation of the subject matter described within this disclosure is a method of repairing cracks within or behind a wellbore casing. The method includes the following features. A mill is received by the wellbore. The mill is received at a target depth. The mill enlarges a section of the wellbore at the target depth. After receiving the mill by the wellbore, an underreamer is received by the wellbore. The underreamer is received at the target depth. The underreamer enlarges the section of the wellbore to a next layer of casing. A pressurized setting fluid is received by the section of the wellbore. A scab liner is received by the section of the wellbore.

Aspects of the example method, which can be combined with the example method alone or in combination with other aspects, include the following. Receiving the pressurized setting fluid includes receiving a plug downhole of the section. A retainer is received uphole of the section. Pressure is received by the retainer. The setting fluid is flowed into channels responsive to the received pressure.

Aspects of the example method, which can be combined with the example method alone or in combination with other aspects, include the following. The setting fluid includes resin or cement.

Aspects of the example method, which can be combined with the example method alone or in combination with other aspects, include the following. The setting fluid is cured.

Aspects of the example method, which can be combined with the example method alone or in combination with other aspects, include the following. Fluid is injected by the wellbore after receiving the scab liner.

Aspects of the example method, which can be combined with the example method alone or in combination with other aspects, include the following. Fluid is produced by the wellbore after receiving the scab liner.

Aspects of the example method, which can be combined with the example method alone or in combination with other aspects, include the following. Receiving the scab liner includes expanding a packer encircling the scab liner. The expanded packer contacts the next layer of casing. The scab liner is cemented within the wellbore.

Aspects of the example method, which can be combined with the example method alone or in combination with other aspects, include the following. An uphole section of an annulus, defined by an outer surface of the scab liner and an inner surface of the next layer of casing, is sealed, by the packer, from a downhole section of the annulus.

Aspects of the example method, which can be combined with the example method alone or in combination with other aspects, include the following. The annulus is sealed by the cement from a primary flow passage defined by an interior surface of the scab liner.

Particular implementations of the subject matter described in this disclosure can be implemented so as to realize one or more of the following advantages. The subject matter described herein allows operators to restore well integrity and improve reliability of sealing communication paths behind casing by introducing additional barriers when compared to traditional techniques.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

In some instances, wellbore integrity can be compromised during a lifespan of the wellbore due to fluid movement behind the inner surface of the casing. Such situations can be caused by micro-annulus or micro-channels forming at an interface between the casing and cement, corrosion induced cracks in the casing, flow channels within the cement and rock wall interface, deformation and connected pores, or a combination of these. Such integrity issues can lead to problems, such as increasing the corrosion rate for the casing, causing casing leaks, contaminating shallow aquifers with production or injection fluid, or any combination of these. As such, repairs are often needed when such an issue is discovered.

This disclosure relates to repairing casing within a wellbore in situations where micro-channels are present within the casing itself or within the cement beyond the casing. The repair includes milling and underreaming the affected section. Once the area is milled and reamed, a scab liner is then run across the section. Resin or cement is then squeezed or injected into the machined section to seal any remaining micro cracks. Packers encircling the scab liner are then expanded, and the scab liner is cemented in place.

Figure 1:
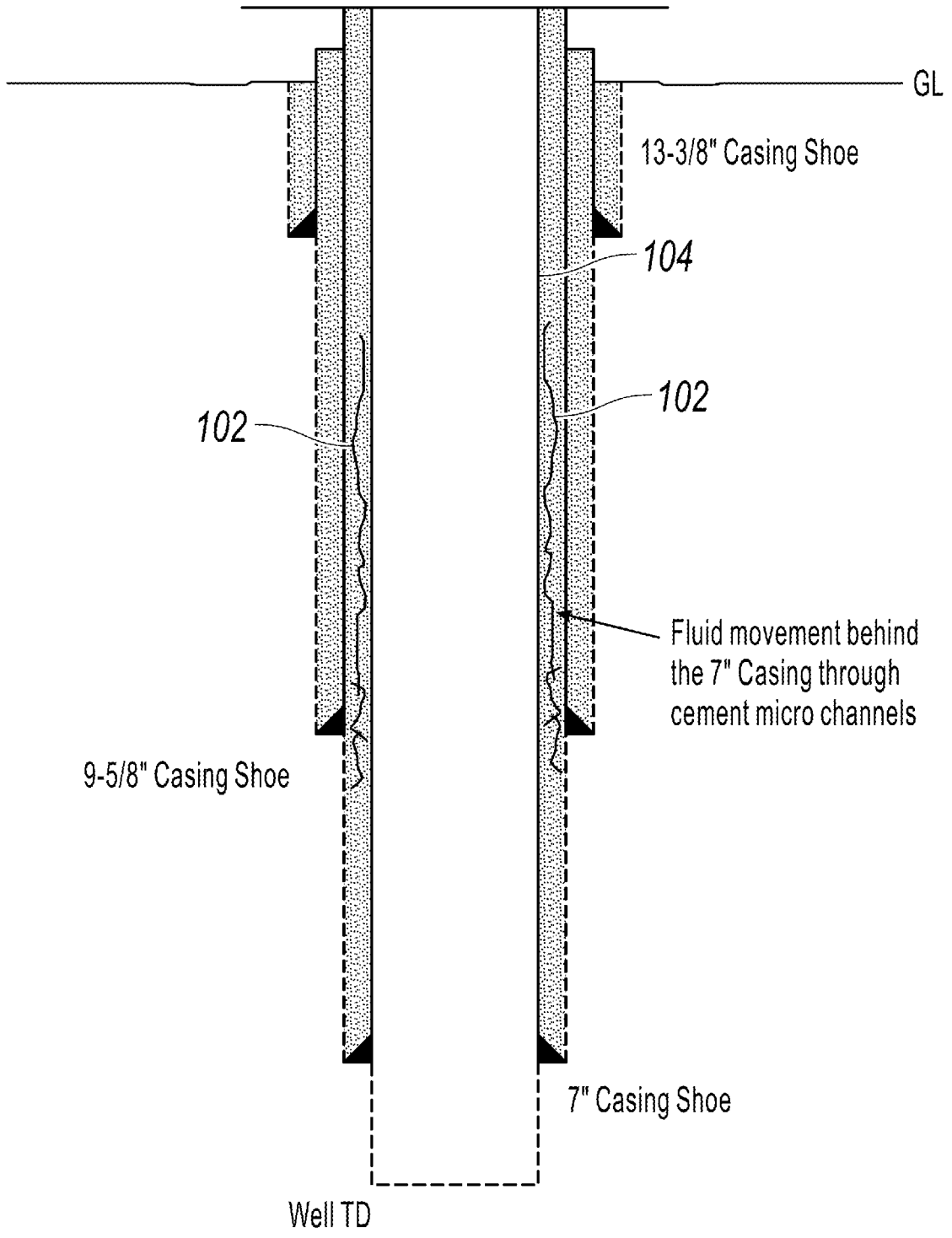
FIG. 1 is a cross-sectional schematic diagram of an example well that can be repaired using aspects of this disclosure.

FIG. 1 is a cross-sectional schematic diagram of an example wellbore 100 that can repaired using aspects of this disclosure. The example wellbore 100 includes a behind-pipe-communication with fluid movement through the communication path defined by the micro-channels 102. In some instances, formation fluid movement behind the casing 104 is confirmed by running logging tools inside the wellbore 100. In this example, the formation fluid moves through the micro-channels 102 from a deep, relatively high-pressure zone to a shallow, relatively low-pressure zone.

Figure 2:
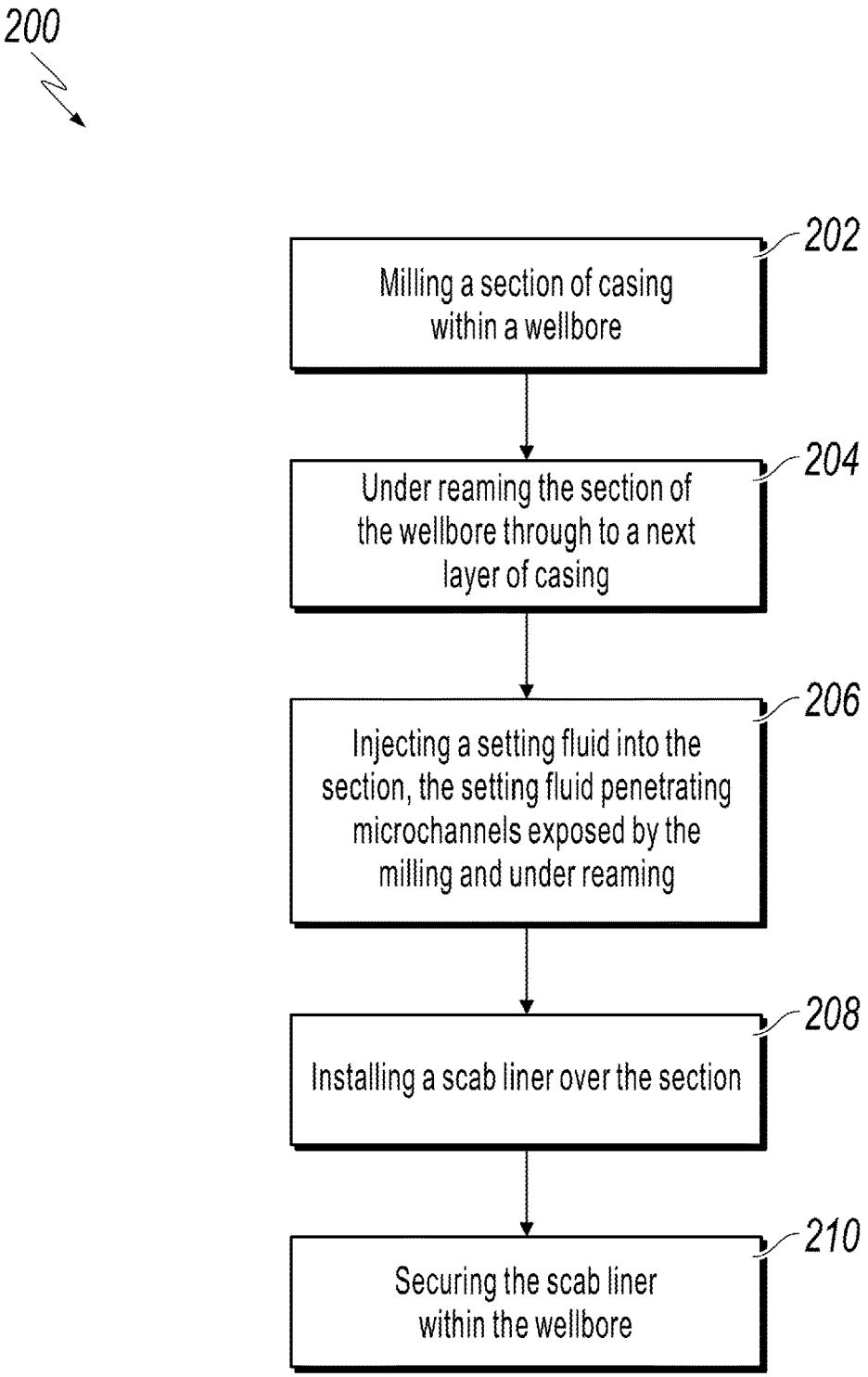
FIG. 2 is a flowchart of an example method that can be used with aspects of this disclosure.

FIG. 2 is a flowchart of an example method 200 that can be used with aspects of this disclosure. The method 200 is explained throughout this disclosure in reference to the figures.

Figure 3:
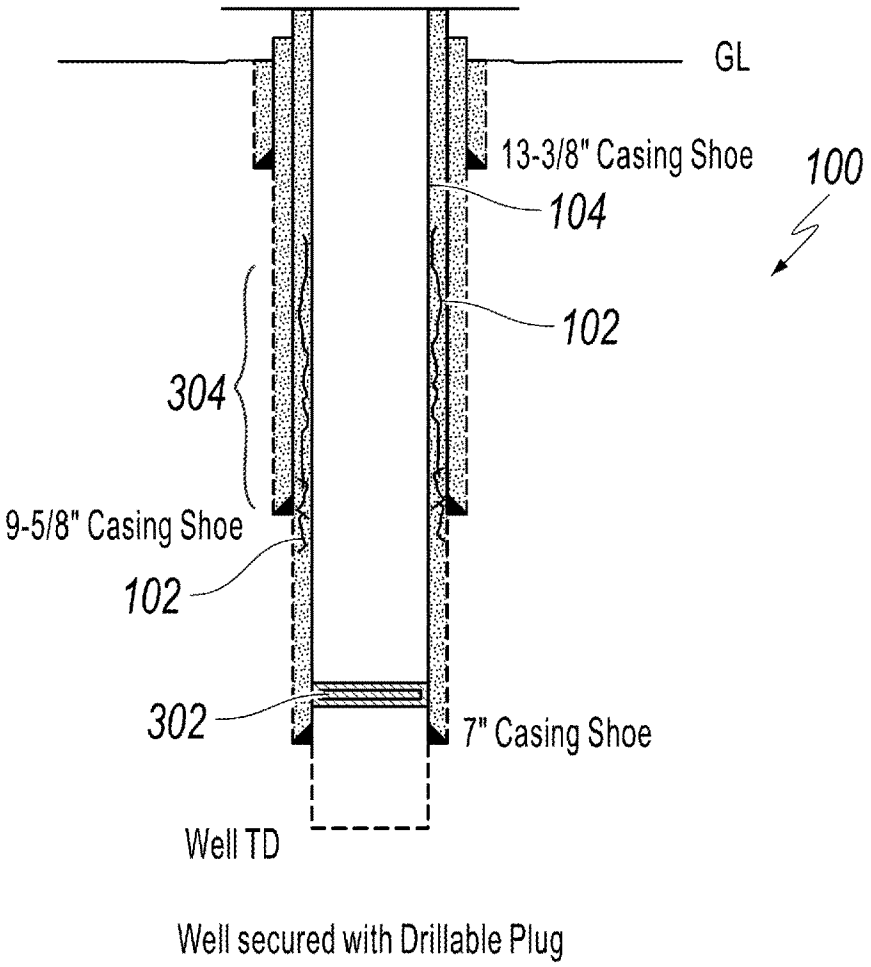
FIG. 3 is a cross-sectional schematic diagram of the example well during repair operations.

FIG. 3 is a cross-sectional schematic diagram of the example wellbore 100 during repair operations. Once the wellbore 100 is shut-in (that is, not producing or injecting fluid), a drillable plug 302 is installed downhole of a section 304 of the wellbore 100 that includes the micro-channels 102. In some implementations, a plug is not used.

Figure 4:
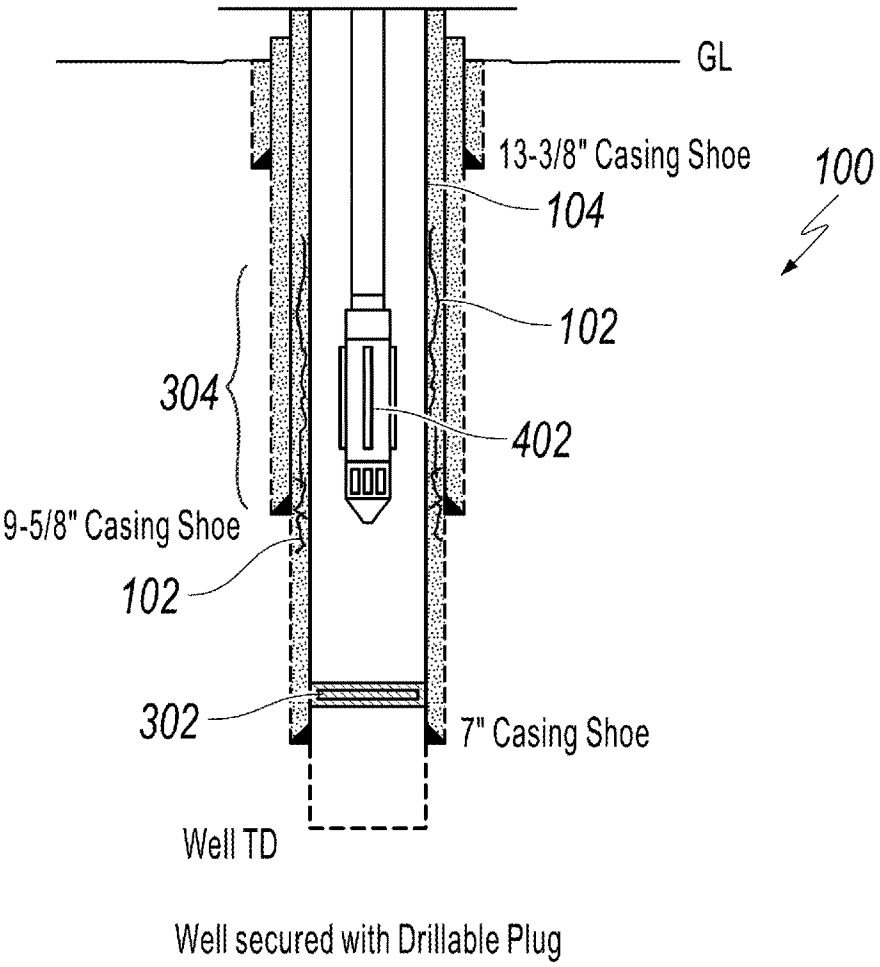
FIG. 4 is a cross-sectional schematic diagram of the example well during repair operations.
Figure 5:
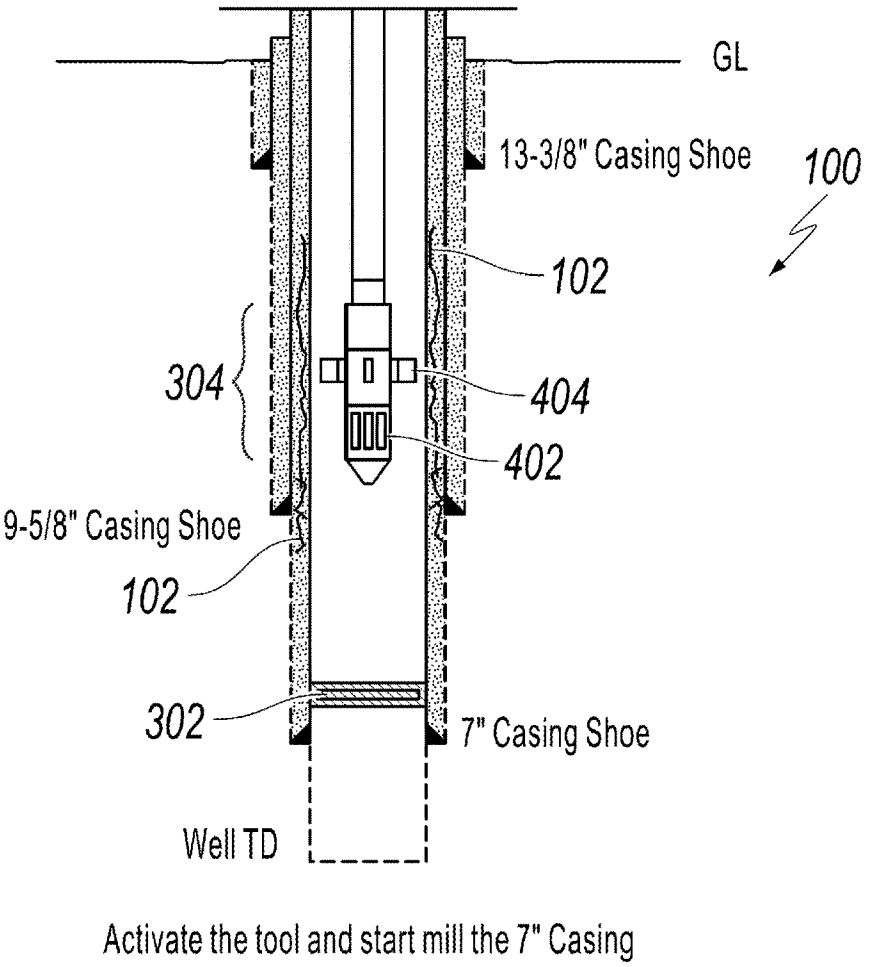
FIG. 5 is a cross-sectional schematic diagram of the example well during repair operations.

Once the plug is installed, as shown in FIG. 4, a mill 402 is received by the wellbore 100. The mill is received at a target depth adjacent to the section 304. Once the mill has reached the target depth, the milling blades 404 are extended as shown in FIG. 5. At 202 (FIG. 2), the section 304 of casing 104 within the wellbore 100 is milled. That is, the mill enlarges the section at the target depth. The target depth can include a length of the wellbore, for example a one hundred foot section 304. In some instances, the milling step may not be performed. Such a decision is determined based on a variety of factors, including casing diameter and the integrity of the cement behind the casing.

Figure 6:
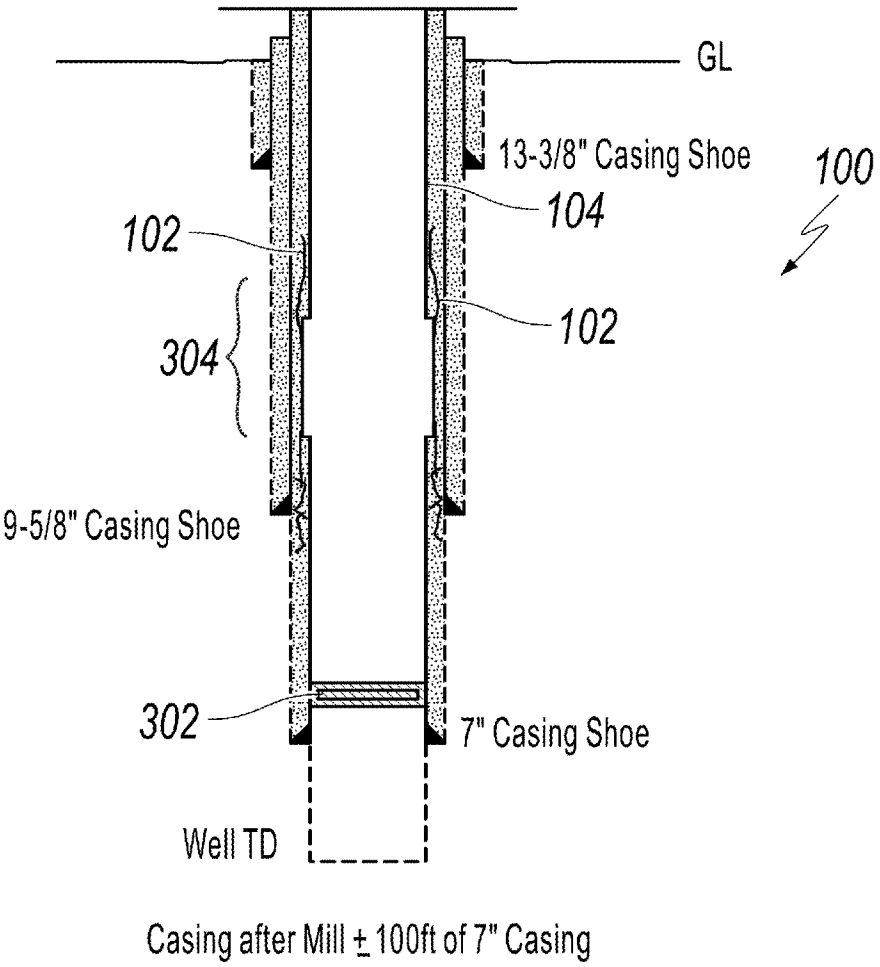
FIG. 6 is a cross-sectional schematic diagram of the example well during repair operations.
Figure 8:
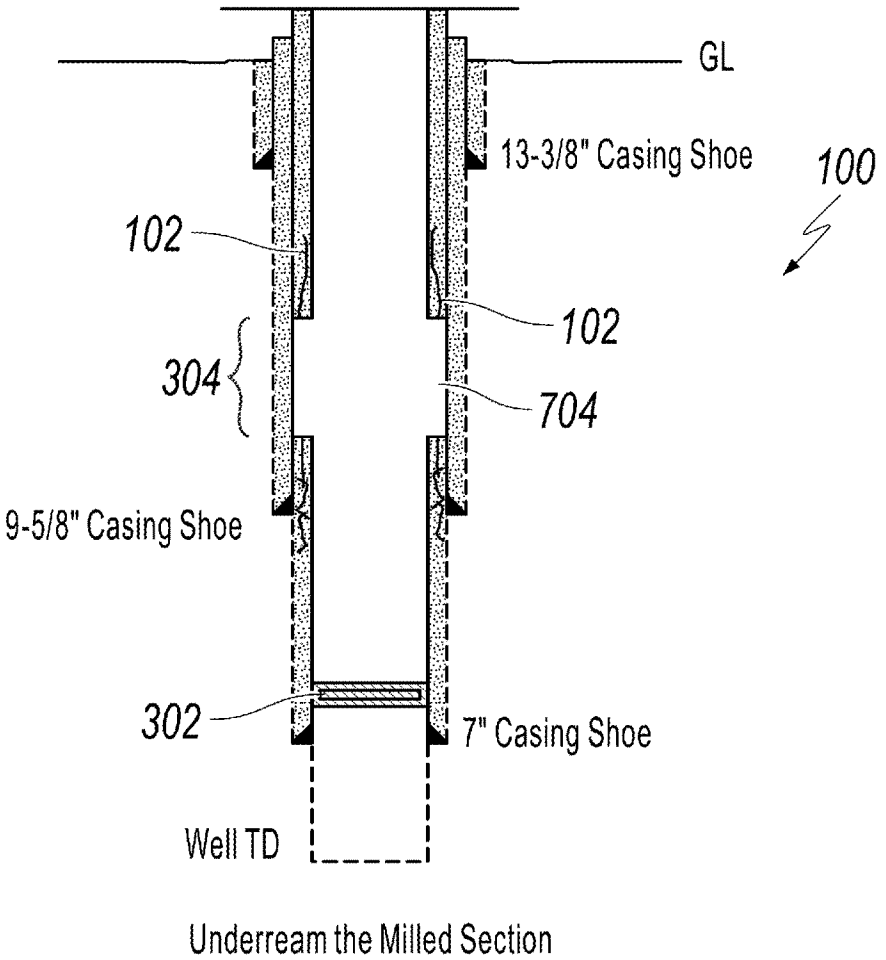
FIG. 8 is a cross-sectional schematic diagram of the example well during repair operations.
Figure 7:
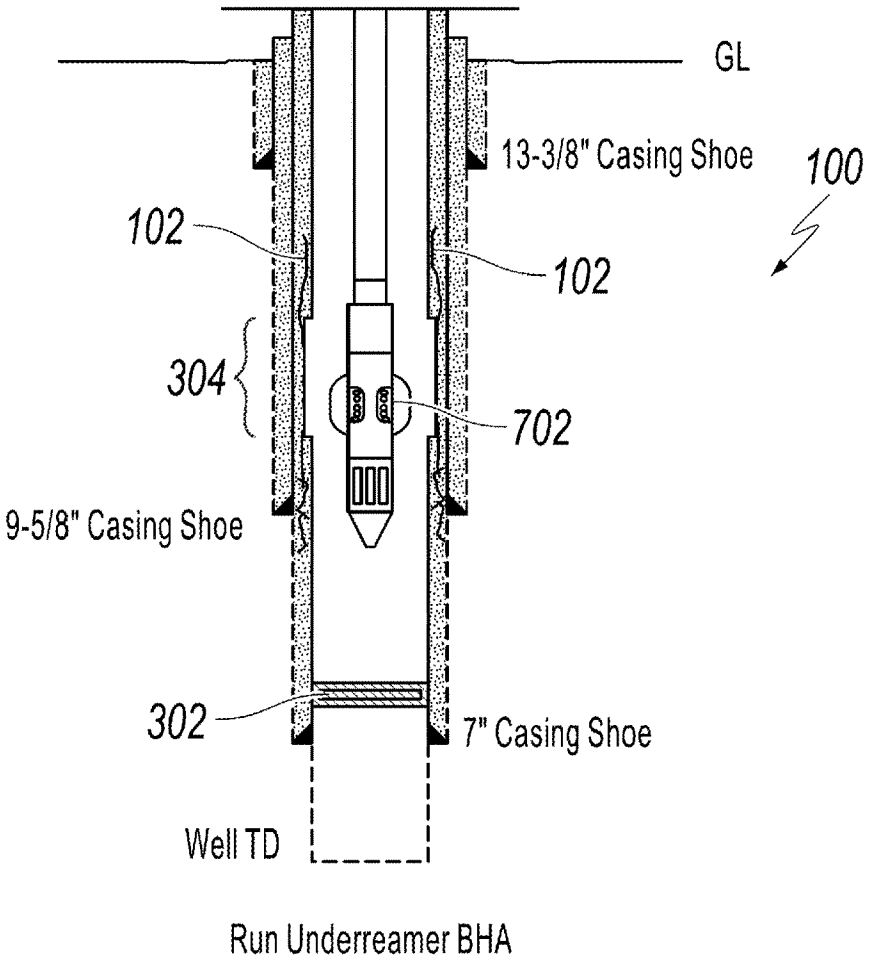
FIG. 7 is a cross-sectional schematic diagram of the example well during repair operations.

As shown in FIG. 6, the milling process removes a first layer of casing and a portion of cement. The milling operation can be considered a "course" operation to remove material. After receiving the mill 402 by the wellbore and removing the mill 402 from the wellbore 100, as shown in FIG. 7, an underreamer 702 is received by the wellbore 100. The underreamer 702 is received at the target depth adjacent to the section 304. At 204 (FIG. 2), after milling the section 304 of the wellbore 100, the section 304 of the wellbore 100 is under reamed through to a next layer of casing 704. That is, the underreamer 702 enlarges the section of the wellbore 100 to the next layer of casing 704, exposing the next layer of casing 704. The underreaming operation can be considered a "fine" operation to remove material. That is, underreaming allows for more controlled removal of material to ensure a smooth inner surface at the next layer of casing 704, as can be seen in FIG. 8.

Figure 9:
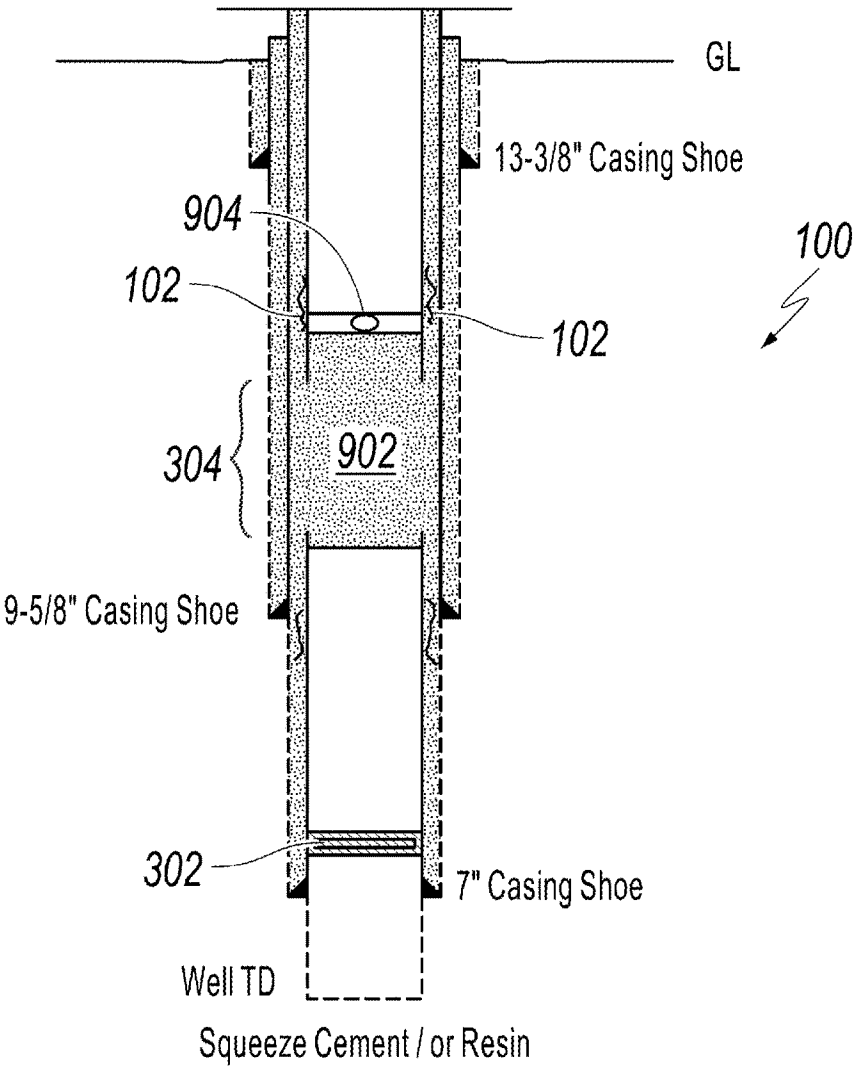
FIG. 9 is a cross-sectional schematic diagram of the example well during repair operations.

As shown in FIG. 9, at 206 (FIG. 2), a setting fluid 902 is injected into the section 304. In some implementations, the setting fluid 902 is injected with the following steps. As mentioned previously, a plug has been previously received by the wellbore and set downhole of the section 304. After underreaming operations are completed, a retainer is received by the wellbore and is set uphole of the section 304. The setting fluid 902 is added to the wellbore prior to setting the retainer 904 or is injected through the retainer 904 into a cavity defined by the section 304, the retainer 904, and the plug 302. The setting fluid 902 is then pressurized by the retainer 904. For example, fluid pressure can be received by the uphole side of the retainer 904. Such pressure can, in some instances, be supplied by a topside facility. This added pressure squeezes the setting fluid 902, causing the setting fluid to flow into the micro-channels 102 exposed by the milling and underreaming operations. That is, the pressurized setting fluid is received by the micro-channels in the section 304. In some implementations, the setting fluid includes a resin or cement. Once the setting fluid 902 is injected into the micro-channels 102, the setting fluid 902 is allowed to cure. In some implementations, the setting fluid 902 cures with little to no intervention. In some implementations, additional steps can be taken to ensure a proper cure. For example, heat or a catalyst can be applied to the section 304 to ensure a proper cure occurs.

Figure 10:
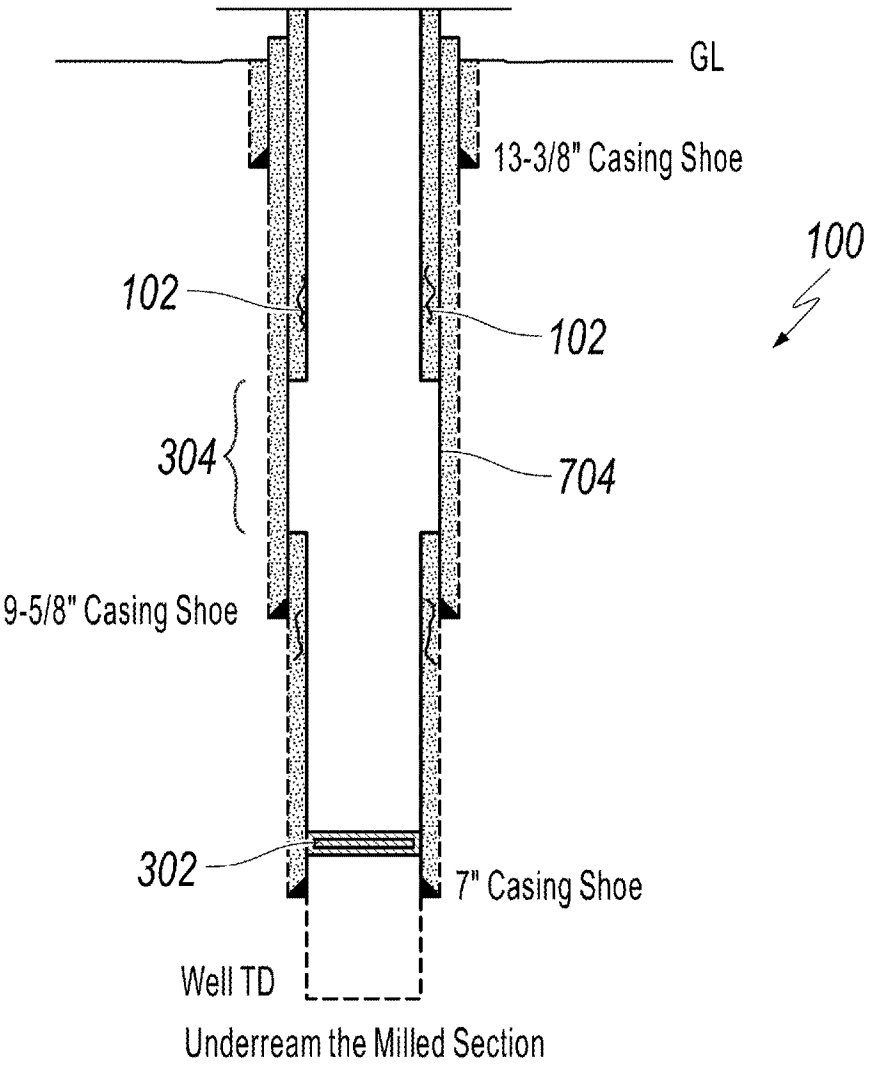
FIG. 10 is a cross-sectional schematic diagram of the example well during repair operations.

Once the setting fluid 902 has cured, the retainer 904 is removed, for example, by drilling out the retainer. Such a stage is illustrated in FIG. 10. The micro-channels 102 are substantially sealed at this point in the repair operations; however, other steps are taken to ensure well integrity after repair operations are completed.

Figure 11:
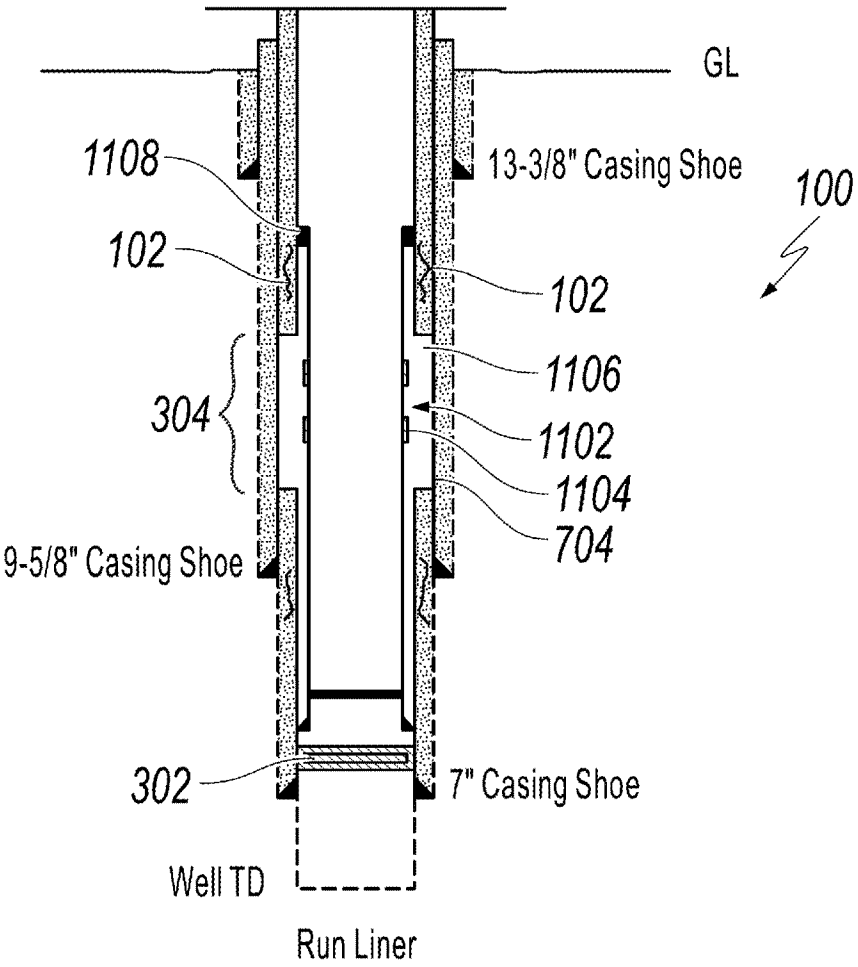
FIG. 11 is a cross-sectional schematic diagram of the example well during repair operations.

As shown in FIG. 11, a scab liner 1102 is received by the section 304 of the wellbore 100. At 208 (FIG. 2), the scab liner 1102 is installed over the section 304. After the scab liner 1102 is installed, at 210, the scab liner 1102 is secured within the wellbore 100, for example, with a liner hanger 1108.

Figure 12:
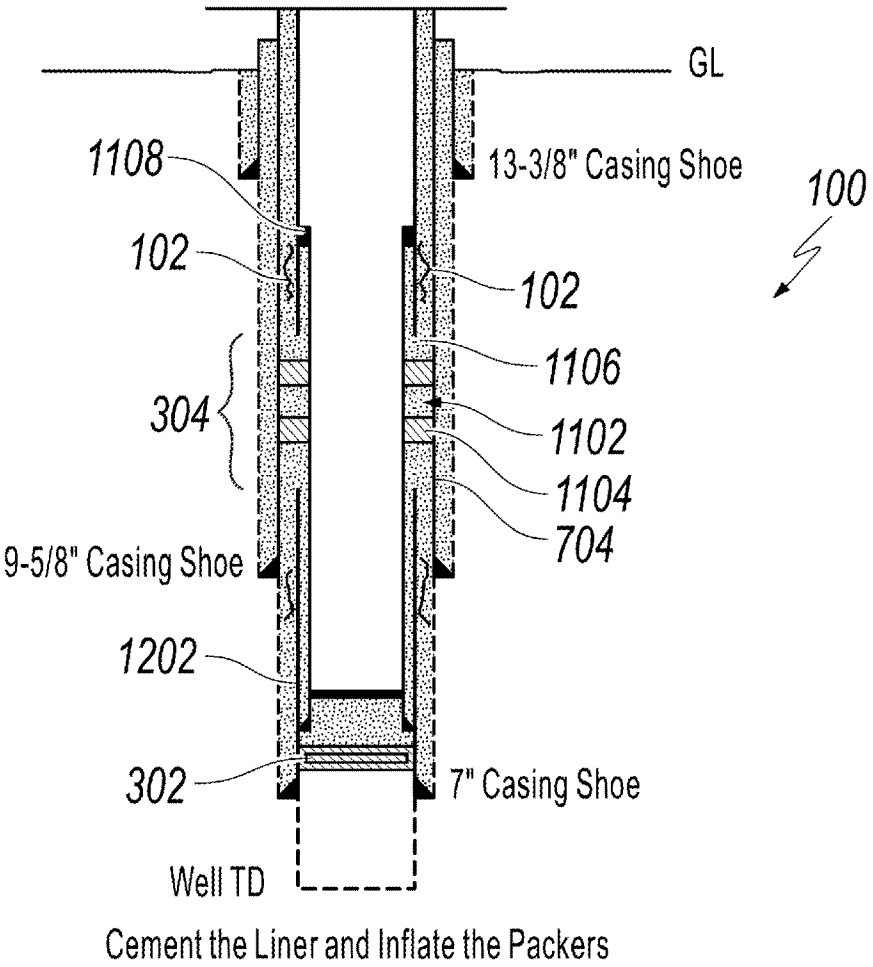
FIG. 12 is a cross-sectional schematic diagram of the example well during repair operations.

FIG. 12 is a cross-sectional schematic diagram of the scab liner 1102 after the scab liner is secured. Securing the scab liner 1102 is done with the line hanger 1108. Prior to the packers 1104 expanding, cement 1202 is pumped into the annulus 1106 to secure the scab liner 1102 within the wellbore 100. In addition to securing the scab liner 1102 within the wellbore 100, the cement also helps seal the annulus 1106 from the primary flow passage 1302 (FIG. 13) of the wellbore. In some implementations, the cement 1202 helps seal an uphole section from the annulus 1106 from a downhole section of the annulus 1106. That is, the cement 1202 can act as an additional seal in series with the cured setting fluid 902, the packers 1104, or both. Prior to the setting fluid 902 curing, the one or more packers 1104 encircling the scab liner 1102 are expanded. The expanded packers 1104 contact the next layer of casing 704 once the scab liner 1102 is installed and secured. The expanded packers 1104 seal an annulus 1106 defined by an outer surface of the scab liner 1102 and an inner surface of the next layer of casing 704. More specifically, the expanded packers 1104 help seal an uphole section of the annulus 1106 from a downhole section of the annulus 1106. That is, the packers 1104 act as an additional, secondary seal in series with the cured setting fluid 902.

Figure 13:
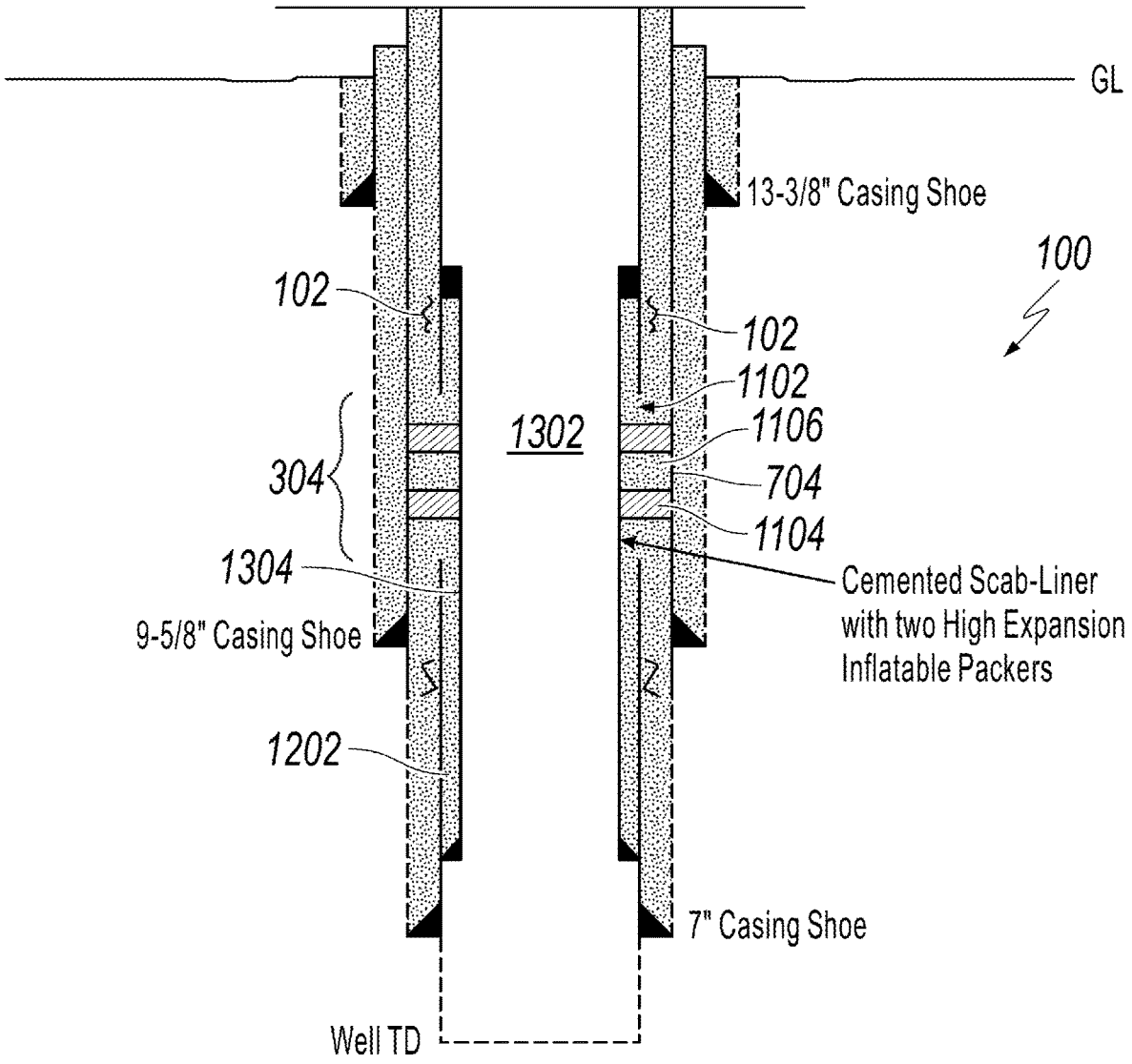
FIG. 13 is a cross-sectional schematic diagram of the example well once repairs have been completed.

FIG. 13 is a cross-sectional schematic diagram of the example wellbore 100 once repairs have been completed. After the scab liner 1102 has been secured in the wellbore, the plug 302 is drilled out. The final arrangement with the installed scab liner includes a central tubular 1304 encircled by the expandable packers 1104. When fully installed, the expandable packers expand to seat against the next layer of casing 704, or outer layer of casing. While primarily illustrated and described as being secured within the wellbore by the cement 1202, in some implementations, other binders are used to secure the scab liner 1102. For example, a resin can be used to secure the scab liner 1102.

Once repairs are complete, the wellbore 100 is put back into operation. For example, in some implementations, fluid is injected into a geologic formation, by the wellbore 100, after the wellbore 100 receives the scab liner 1102. In some implementations, fluid is produced from a geologic formation, by the wellbore, after the wellbore 100 receives the scab liner 1102.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A scab liner arrangement comprising:

a milling assembly configured to mill a section of casing within a wellbore;

an underreaming assembly configured to underream the section of casing through to a next layer of casing after the milling assembly mills the section of casing;

a settling fluid configured to be squeezed into the section, the setting fluid configured to penetrate micro-channels exposed by the milling assembly and the underreaming assembly;

a scab liner comprising a central tubular, the scab liner configured to be installed over the section; and an expandable packer encircling the scab liner, the expandable packer configured to expand and seat against the outer casing within the wellbore.

2. The arrangement of claim 1, wherein the setting fluid comprises cement or resin.

3. The arrangement of claim 1, wherein the expandable packer is configured to encircle the scab liner and contact the next layer of casing, wherein the scab liner is configured to be cemented.

4. The arrangement of claim 3, wherein the expandable packer is configured to seal an uphole section of an annulus defined by an outer surface of the scab liner and an inner surface of the next layer of casing, from a downhole section of the annulus.

5. The arrangement of claim 1, further comprising:

a plug configured to be set downhole of the section;

a retainer configured to be set uphole of the section, wherein the retainer is configured to pressurize the setting fluid to flow into a plurality of channels.

6. The arrangement of claim 5, wherein the retainer is configured to be drilled out.

7. The arrangement of claim 5, wherein the plug is configured to be drilled out.

* * * * *